US006351942B1

(12) United States Patent
Nishimura et al.

(10) Patent No.: US 6,351,942 B1
(45) Date of Patent: Mar. 5, 2002

(54) CONTROL SYSTEM FOR A DIRECT INJECTION ENGINE OF SPARK IGNITION TYPE

(75) Inventors: Hirofumi Nishimura; Hiroshi Tokushige; Keiji Araki, all of Fuchu-cho (JP)

(73) Assignee: Mazda Motor Corporation, Hiroshima-Ken (JP)

( * ) Notice: Subject to any disclaimer, the term of this patent is extended or adjusted under 35 U.S.C. 154(b) by 0 days.

(21) Appl. No.: 09/659,488

(22) Filed: Sep. 11, 2000

(30) Foreign Application Priority Data

Sep. 30, 1999 (JP) ..... 11-280696

(51) Int. Cl.[7] ..... F01N 3/00

(52) U.S. Cl. ..... 60/285; 60/295; 60/301; 60/289

(58) Field of Search ..... 60/274, 285, 286, 60/295, 301, 289, 292, 290; 123/681, 682, 683, 687, 299, 300

(56) References Cited

U.S. PATENT DOCUMENTS 4,955,339 A * 9/1990 Sasaki et al. ..... 123/300
5,685,283 A * 11/1997 Nishioka et al. ..... 123/681
5,768,887 A * 6/1998 Nakamura et al. ..... 60/274
5,848,529 A * 12/1998 Katoh et al. ..... 60/285
5,975,046 A * 11/1999 Kaneko et al. ..... 60/285
6,021,638 A * 2/2000 Hochmuth ..... 60/285
6,055,956 A * 5/2000 Nishimura et al. ..... 123/299
6,085,718 A * 7/2000 Nichimura et al. ..... 123/299
6,116,208 A * 9/2000 Nishimura et al. ..... 60/278
6,138,638 A * 10/2000 Morikawa ..... 123/295
6,161,377 A * 12/2000 Boegner et al. ..... 60/285

FOREIGN PATENT DOCUMENTS

JP 11-36959 2/1999
JP 11-082097 3/2000

* cited by examiner

*Primary Examiner*—Thomas Denion
*Assistant Examiner*—Diem Tran
(74) *Attorney, Agent, or Firm*—Nixon Peabody LLP; Donald R. Studebaker

(57) ABSTRACT

A direct injection engine of sparking ignition type has a catalyst in an exhaust passage and a fuel injection valve for directly spraying fuel into a combustion chamber. An ECU for controlling the engine is provided with a setter and an air-fuel ratio controller. The setter sets an enriched region where an air-fuel ratio is smaller than a stoichimetric air-fuel ratio in a high engine speed and load area of an operating region of the engine, a stoichimetric air-fuel ratio region where the air-fuel ratio is equal to the stoichimetric air-fuel ratio in an area of the operating region of the engine having lower engine speed or load than the enriched region, and a lean region where the air-fuel ratio is larger than the stoichimetric air-fuel ratio between the stoichimetric air-fuel ratio region and the enriched region. The air-fuel ratio controller controls the air-fuel ratio based on the setting by the setter. Accordingly, a rise in exhaust gas temperature can be suppressed in the operating region having high engine speed and load, thereby significantly improving fuel consumption at high speeds while ensuring reliability.

15 Claims, 3 Drawing Sheets

CONTROL SYSTEM FOR A DIRECT INJECTION ENGINE OF SPARK IGNITION TYPE

BACKGROUND OF THE INVENTION

This invention relate to a control system for a direct injection engine of spark ignition type which is provided with a fuel injection valve for directly spraying fuel into combustion chambers and a catalyst in an exhaust passage.

As disclosed, for example, in Japanese Unexamined Patent Publication No. 11-36959, a conventional control system is provided with a fuel injection valve for directly spraying fuel into combustion chambers and a controller for causing the fuel to be sprayed during a compression stroke to carry out a stratified combustion in a specific low engine speed/low load operating region while causing it to be sprayed during an intake stroke to carry out a premix combustion (uniform combustion) in other operating regions.

In the engine of this type, among the operating regions where uniform combustion is carried out, a high engine speed/high engine load region is referred to as an enriched region, and a region having a lower engine speed and a lower engine load than the enriched region is referred to as a stoichiometric air-fuel ratio region. In the stoichiometric air-fuel ratio region, a required output is achieved by controlling a fuel injection amount and an intake air amount such that an air-fuel ratio becomes a stoichiometric air-fuel ratio, and satisfactory emissions are maintained by improving an exhaust gas purifying performance by a catalyst in the exhaust passage. On the other hand, in the enriched region, an output is increased by increasing the fuel injection amount to decrease the air-fuel ratio below the stoichiometric air-fuel ratio, and a rise in exhaust gas temperature is suppressed by a thermal capacity and latent heat by vaporization of an excessive fuel to thereby prevent an excessive heating of the catalyst provided in the exhaust passage to ensure a satisfactory reliability.

In the conventional system, it is desirable to make the enriched region as small as possible for the improvement of fuel consumption at high speeds (fuel consumption in a high engine speed region) since the fuel is excessively fed in the enriched region to increase an amount of fuel consumed. However, extension of the stoichiometric air-fuel ratio region to the high engine speed/high load region by reducing the enriched region is not preferable in terms of reliability since a larger amount of heat is generated at the stoichiometric air-fuel ratio to thereby make the exhaust gas temperature likely to rise.

SUMMARY OF THE INVENTION

It is an object of the present invention to provide a control system for a direct injection engine of spark ignition type which is free from the problems residing in the prior art.

According to an aspect of the invention, a control system is adapted for a direct injection engine of sparking ignition type including a catalyst in an exhaust passage and a fuel injection valve for directly spraying fuel into a combustion chamber. The control system is provided with a setter for setting an enriched region where an air-fuel ratio is smaller than a stoichiometric air-fuel ratio in a high engine speed and load area of an operating region of the engine, setting a stoichiometric air-fuel ratio region where the air-fuel ratio is equal to the stoichiometric air-fuel ratio in an area of the operating region of the engine having lower engine speed or lower engine load than the enriched region, and setting a lean region where the air-fuel ratio is larger than the stoichiometric air-fuel ratio between the stoichiometric air-fuel ratio region and the enriched region; and an air-fuel ratio controller for controlling the air-fuel ratio based on the setting by the setter.

In the direct injection engine of sparking ignition type, the lean region where the air-fuel ratio is larger than the stoichiometric air-fuel ratio is set between the enriched region having high engine speed and load and the stoichiometric air-fuel ratio region having lower engine speed and load than the enriched region. Accordingly, rise in exhaust gas temperature is suppressed in the lean region, thereby preventing superheating of the catalyst and enhancing combustion efficiency to improve fuel consumption.

These and other objects, features and advantages of the present invention will become more apparent upon a reading of the following detailed description and accompanying drawings.

DETAILED DESCRIPTION OF THE PREFERRED EMBODIMENTS OF THE INVENTION

Figure 1:
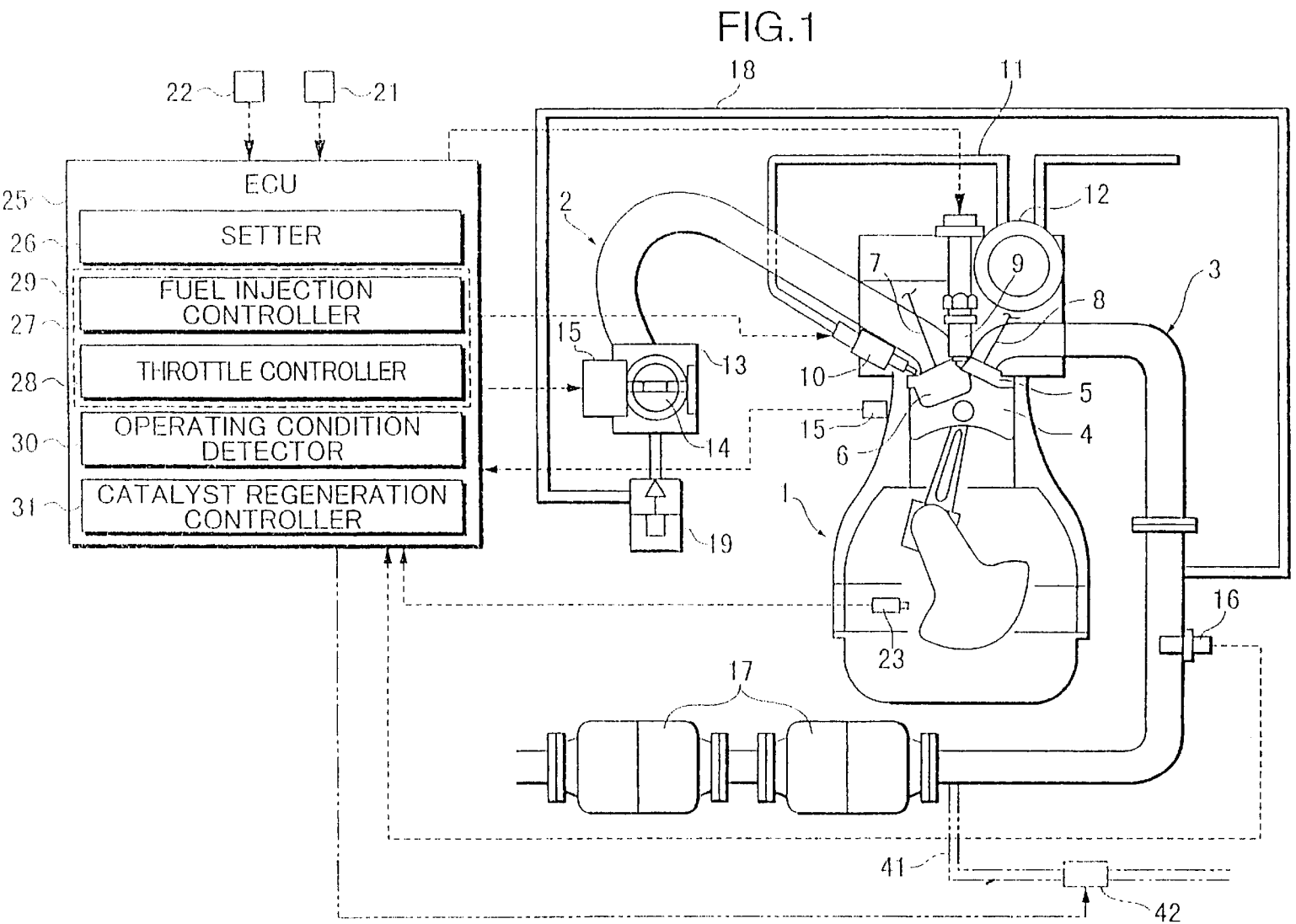
FIG. 1 is a schematic diagram entirely showing an engine according to one embodiment of the invention.

Referring to FIG. 1 showing an entire construction of a direct injection engine of spark ignition type according to an embodiment of the invention, this engine is a gasoline engine mountable in an automotive vehicle, and is comprised of a main engine unit 1, an intake passage 2 and an exhaust passage 3 which are connected with the main engine unit 1. The main engine unit 1 has a plurality of cylinders, in each of which a combustion chamber 5 is defined above a piston 4 inserted into a cylinder bore. An intake valve 17 and an exhaust valve 18 for opening and closing an intake port and an exhaust port are provided for each combustion chamber, and a spark plug 9 is provided at a top of the combustion chamber 5.

Further, a fuel injection valve 10 for directly spraying fuel into the combustion chamber 5 is provided at a peripheral portion of the combustion chamber 5. A recess-shaped cavity 6 is formed at the top of the piston 4. The positional relationship of the fuel injection valve 10, the cavity 6 and the spark plug 9 is set in advance, such that, during stratified combustion, the fuel is sprayed from the fuel injection valve 10 toward the cavity 6 in the second half of a compression stroke where the piston 4 is located close to top dead center and is reflected by the cavity 6 to reach near the spark plug 9.

A high-pressure fuel pump 12 is connected to the fuel injection valve 10 via a fuel supply passage 11. The fuel pump 12 is driven by the engine and controlled to provide the fuel injection valve 10 with such a fuel pressure as to enable fuel injection at a point later than the middle phase of the compression stroke. Specifically, the fuel pump 12 generates a fuel pressure of 4 MPa or higher at least in a lean region.

A surge tank 13 is provided in the intake passage 12, and a throttle valve 14 for regulating an intake air amount charge to be admitted into the combustion chambers is provided upstream from the surge tank 13. The throttle valve 14 is electrically driven so that the intake air amount can be effectively controlled, for example, when an air-fuel ratio is changed, i.e., is driven by an electrical actuator 15 which operates in accordance with a control signal.

An $O_2$ sensor for 16 detecting an air-fuel ratio of an exhaust gas is provided in the exhaust passage 3, and a catalyst 17 for purifying the exhaust gas is provided downstream from an upstream exhaust pipe connected with an exhaust manifold of the engine. The catalyst 17 may be a three way catalyst. However, it is desirable to use such a catalyst capable of effectively purifying NOx even under a lean condition that the air-fuel ratio is higher than a stoichiometric air-fuel ratio in order to improve a purifying performance when stratified combustion is carried out at a lean air-fuel ratio. In this embodiment, a lean NOx catalyst is used which absorbs NOx in the exhaust gas in an excess oxygen atmosphere, releases the absorbed NOx when an oxygen concentration falls by the change of the air-fuel ratio from the lean side to the rich side, and causes NOx to be reduced by a reducing agent such as CO present in the atmosphere.

Even with such a lean NOx catalyst, purifying performance is highest at or near the stoichiometric air-fuel ratio.

An EGR (exhaust gas recirculation) system for recirculating part of the exhaust gas to an intake system is provided between the exhaust passage 3 and the intake passage 2, and is comprised of an EGR passage 18 for connecting the exhaust passage 3 and the intake passage 2 and an EGR valve provided in the EGR passage 18.

The engine is equipped with a variety of sensors including an air flow sensor 21 for detecting a flow rate of the intake air passing through the intake passage 2, an acceleration pedal travel sensor 22 for detecting a travel of an acceleration pedal upon depression and a crank angle sensor 23 for detecting a crank angle for the detection of an engine speed or the like, in addition to the $O_2$ sensor 16. Detection signals of these sensors are inputted to an engine control unit (ECU) 25.

The ECU 25 is comprised of a setter 26 for setting air-fuel ratio control regions, an air-fuel ratio controller 29 including a fuel injection controller 27 and a throttle controller 28, an operating condition detector 30 and a catalyst regeneration controller 31.

Figure 2:
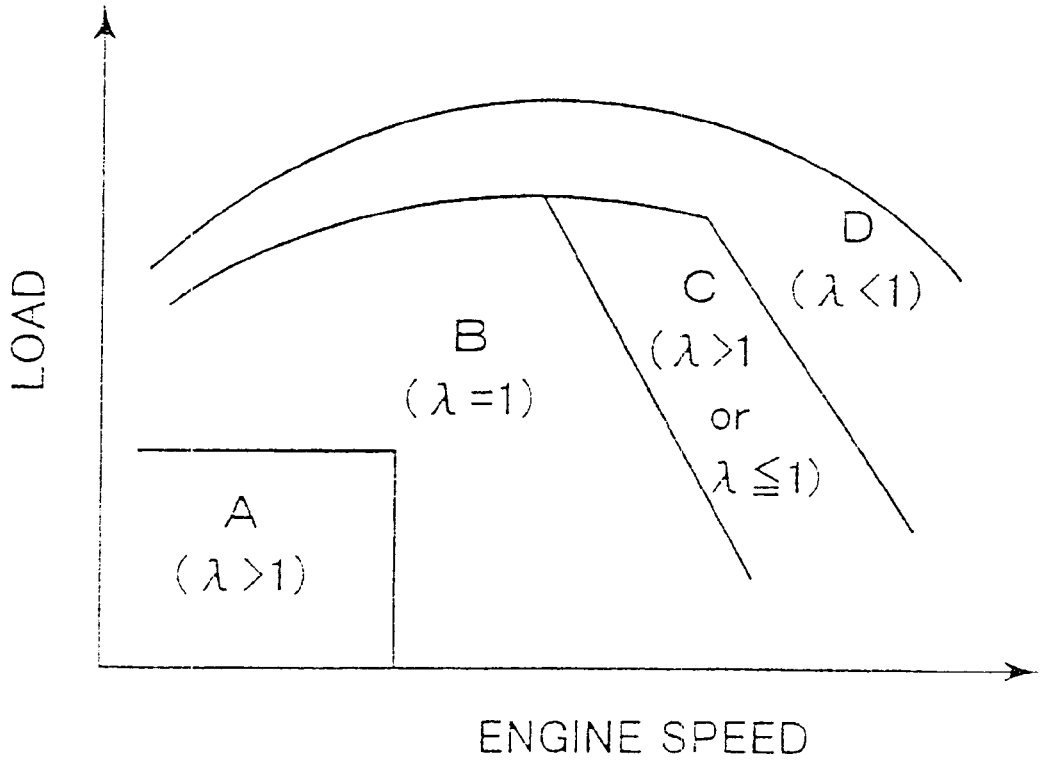
FIG. 2 is a graph showing how operating regions are set for a fuel injection control or other purpose.

The setter 26 sets the air-fuel ratio control regions as shown in FIG. 2. specifically, an operating region of the engine having a specified low engine speed/low engine load range is referred to as a stratified combustion region A where stratified combustion is carried out by fuel injection during the compression stroke as described in detail later. A region having higher engine speed and higher engine load than the stratified combustion region A is referred to as a uniform combustion region where uniform combustion is carried out by fuel injection during the intake stroke as described in detail later. In the uniform combustion region, an enriched region D, a stoichiometric air-fuel ratio region B and a lean region C are further defined. The enriched region D is set at a high engine speed/high engine load side, and the air-fuel ratio is smaller than the stoichiometric air-fuel ratio (i.e., rate of excess air $\lambda<1$) therein. The stoichiometric air-fuel ratio region B is set at a lower engine speed and lower engine load side than the enriched region D, and the air-fuel ratio is equal to the stoichiometric air-fuel ratio (i.e., $\lambda.=1$) therein. The lean region C is set between the regions B and D, and the air-fuel ratio is larger than the stoichiometric air-fuel ratio (i.e., (i.e., $\lambda.>1$) therein.

Specifically, the enriched region D extends from a high engine load region near a maximum engine load to a high engine speed region near a maximum engine speed. The stoichiometric air-fuel ratio region B substantially extends from a medium engine load region of the low engine speed region to the low/medium engine load region of the medium engine speed region. The lean region C is set in a relative high engine speed region between the regions B and D.

The fuel injection controller 27 controls an amount and a timing of fuel injection from the fuel injection valve 10, and the throttle controller 28 controls an opening of the throttle valve 14 by controlling the actuator 15. The air-fuel ratio controller 29 including the fuel injection controller 27 and the throttle controller 28 controls the intake air amount (throttle opening) and the fuel injection amount based on the setting by the setter 26 to set a lean state ($\lambda>1$) where the air-fuel ratio is considerably larger than the stoichiometric air-fuel ratio and causes the fuel injection valve 10 to spray the fuel during the compression stroke to carry out stratified combustion in the stratified combustion region A. Further, in the uniform combustion region, the controller 29 causes the fuel injection valve 10 to spray the fuel during the intake stroke to carry out uniform combustion, and controls the intake air amount (throttle opening) and the fuel injection amount to achieve air-fuel ratios corresponding to the respective regions B, C, D.

The operating condition detector 30 detects an operating condition based on the engine speed obtained from a signal of the crank angle sensor 22 and an engine load obtained from a signal of the acceleration pedal travel sensor 23. Based on this detection, a judgment is made as to in which region of the map of the FIG. 2 the present operation condition lies, and an accelerative operating condition is discriminated.

The catalyst regeneration controller 31 executes a regeneration control for releasing sulfur from the catalyst 17 upon reaching a specified sulfur absorbed state where the NOx absorbing performance of the catalyst 17 is hindered.

Specifically, the aforementioned lean NOx catalyst has a property of being likely to absorb sulfur oxides (SOx) in the exhaust gas more than NOx therein if fuel or engine oil contains sulfur components. If the lean NOx catalyst is poisoned by sulfer, sulfer can be released from the catalyst by increasing a catalyst temperature and an amount of CO in the exhaust gas.

Accordingly, the controller 31 checks a sulfur absorbed state of the catalyst 17 by adding sulfur absorption amounts per unit time obtained by a map, for example, according to the operating condition, and executes such a control as to rise the exhaust gas temperature while rising the air-fuel ratio in order to release sulfur from the catalyst 17 when the specified sulfur absorbed state is reached. The controller 31 changes the air-fuel ratio to or below the stoichiometric air-fuel ratio (i.e., $\lambda<1$) upon reaching a specified sulfur absorbed state in the lean region C.

Figure 3:
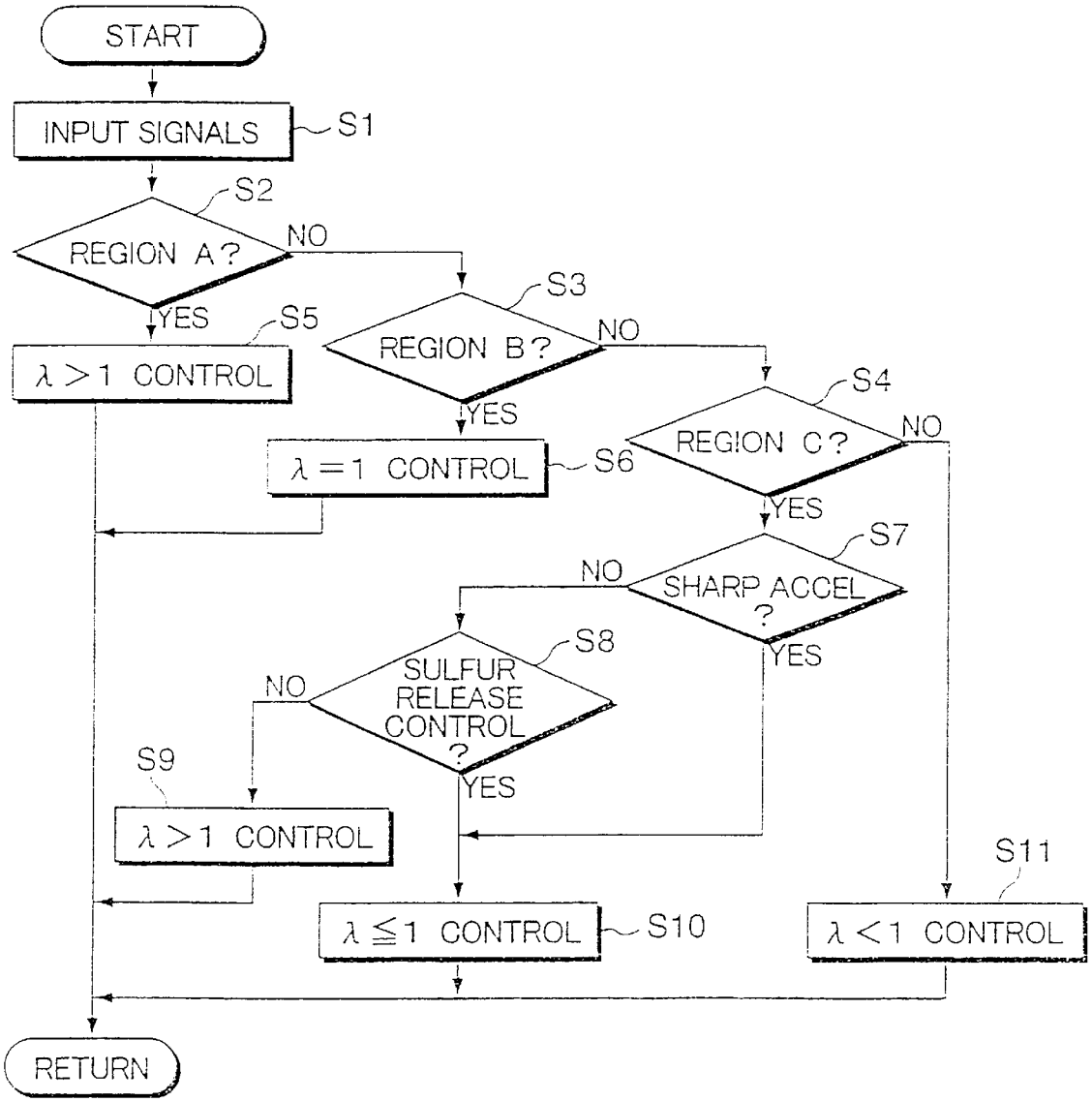
FIG. 3 is a flow chart showing specific contents of a control.

A specific example of the control by the ECU 25 is described with reference to a flow chart of FIG. 3.

Upon start of a processing shown in this flow chart, various signals representing the flow rate of the intake air detected by the air flow sensor 21, the travel of the acceleration pedal detected by the acceleration pedal travel sensor 22, the engine speed obtained by measuring the cycle of the signal from the crank angle sensor 23, and an output of the $O_2$ sensor 16 are inputted in Step S1. Subsequently, an operating condition is detected based on the engine load and the engine speed and whether the detected operating condition lies in the stratified combustion region A is judged (Step 52). If the judgment result is negative (NO in Step S2), whether the detected operating condition lies in the stoichimetric air-fuel ratio region B is judged (Step S3). If the judgment result is negative (NO in Step S3), whether the detected operating condition lies in the lean region C is judged (Step S4). A following control is executed according to the judgment results in Steps S2 to S4.

Specifically, if the detected operating condition is judged to lie in the stratified combustion region A in Step S2, stratified combustion is carried out by causing the fuel injection valve 10 to spray the fuel during the compression stroke, and the intake air amount and the fuel injection amount are so controlled as to reduce the air-fuel ratio smaller than the stoichiometric air-fuel ratio ($\lambda>1$) (Step S5).

If the detected operating condition is judged to lie in the air-fuel ratio region B in Step S3, uniform combustion is carried out by causing the fuel injection valve 10 to spray the fuel during the intake stroke, and the intake air amount and the fuel injection amount are so controlled as to equal the air-fuel ratio to the stoichiometric air-fuel ratio ($\lambda=1$) (Step S6). In this case, the intake air amount is regulated by, for example, controlling the throttle opening according to the travel of the acceleration pedal, whereas the fuel injection amount is controlled to achieve the stoichiometric air-fuel by a feedback control according to the output of the $O_2$. sensor 16.

If the detected operating condition is judged to lie in the lean region C in Step S4, it is further judged whether the engine is undergoing a sharp acceleration based on a calculated rate of change of the travel of the acceleration pedal in Step S7. Unless the engine is undergoing a sharp acceleration, it is judged whether the sulfur release control is being executed in Step S8.

If the engine is undergoing neither the sharp acceleration nor the sulfur release control in the lean region C, uniform combustion is carried out by causing the fuel injection valve 10 to spray the fuel during the intake stroke, and the air-fuel ratio is controlled to be lean ($\lambda>1$) (Step S9). In other words, the fuel injection amount is controlled according to a required torque determined by the engine speed, the travel of the acceleration pedal, etc., whereas the air-fuel ratio is decrease by admitting a larger amount of intake air by increasing the throttle opening as compared to a case where the air-fuel ratio is controlled to equal the stoichiometric air-fuel ratio.

Further, if the engine is undergoing the sharp acceleration or the sulfur release control in the lean region C, the intake air amount and the fuel injection amount are controlled such that the air-fuel ratio is equal to or smaller than the stoichiometric air-fuel ratio ($\lambda<1$) (Step S10).

If the judgment results are all negative in Steps S2 to S4, it means that the present operating condition lies in the enriched region D. In such a case, the air-fuel ratio is controlled to be smaller ($\lambda<1$) by increasing the fuel injection amount (Step S11).

In the thus constructed control system according to this embodiment, stratified combustion is carried out by spraying the fuel during the compression stroke in the stratified combustion region A where the fuel injection mount is relatively small and both the engine load and the engine speed are low. Accordingly, the air-fuel ratio is excessively large in the combustion chamber as a whole while sufficient ignitability and combustibility are achieved by keeping the air-fuel ratio around the sparking plug at a proper vale. This reduces a pumping loss and improves a combustion efficiency, thereby significantly improving fuel consumption.

In the uniform combustion region extending from the medium/high engine load region to the medium/high engine speed region, uniform combustion is carried out by spraying the fuel during the intake stroke, with the result that a satisfactory combustibility can be achieved under the condition that the fuel injection amount is relatively large. In the stoichiometric air-fuel ratio region B of the uniform combustion region where the engine load and/or the engine speed are low, the exhaust gas purifying performance of the catalyst 17 is improved to achieve satisfactory emissions by controlling the air-fuel ratio to equal the stoichiometric air-fuel ratio.

In the lean region C between the stoichiometric air-fuel ratio region B and the enriched region D which is set at the relatively high engine speed side, the air-fuel ratio is made larger than the stoichiometric air-fuel ratio by increasing the throttle opening to increase the intake air amount. This suppresses a rise in exhaust gas temperature and improves fuel consumption at high speeds. In other words, the exhaust gas temperature rises if the engine speed and the engine load increase, making superheating of the catalyst 17 likely to occur. In such a case, a rise in the temperature of the catalyst 17 can be alleviated to a certain degree if the catalyst 17 is provided in a relatively downstream position of the exhaust passage 3 as in this embodiment. However, such an arrangement alone cannot prevent the temperature of the catalyst 17 from excessively increasing.

Contrary to this, if the air-fuel ratio is increased by increasing the intake air amount, a rise in exhaust gas temperature is suppressed by the thermal capacity of the abundantly available air, and superheating of the catalyst 17 is prevented to thereby improve reliability. Since combustion efficiency is improved by increasing the air-fuel ratio, fuel consumption can be significantly improved as compared to a case where the air-fuel ratio is decreased. Further, since combustion stability is basically high in the operating region at the relatively high engine speed side, a sufficient combustion stability can be ensured even if the air-fuel ratio is increased in the uniform combustion.

If the engine load and the engine speed are further increased, a rise in exhaust gas temperature cannot be sufficiently suppressed by the control to increase the air-fuel ratio, and the output cannot be increased. Accordingly, in such an operating region where the engine speed and the engine load are both high (enriched region D), the air-fuel ratio is reduced by increasing the fuel injection amount. This increases the output and suppresses a rise in exhaust gas temperature by the thermal capacity of the redundant fuel and latent heat by vaporization, preventing superheating of the catalyst 17 to improve reliability.

The air-fuel ratio is increased in the high engine load region near the maximum engine load and in the high engine speed region near the maximum engine speed, i.e., in the enriched region D. The enriched region D is set maximally smaller. By increasing the air-fuel ratio in the lean region C at the relatively high engine speed side between the enriched region D and the stoichiometric air-fuel ratio region B, fuel consumption at high speeds can be significantly improved while an excessive rise in exhaust gas temperature can be suppressed.

Further, the high-pressure fuel pump 12 driven by the engine to produce a high fuel pressure is provided in the engine according to this embodiment. As the engine speed increases, the pump 12 has an increasing resistance to drive. Further, the cavity 6 formed at the top of the piston 4 for promoting a satisfactory stratification acts to disturb a uniform distribution of the air-fuel mixture during the uniform combustion by the fuel injection during the intake stroke and leads to a cooling loss. These factors hinder an improvement of fuel consumption at high speeds. Even with these factors, fuel consumption at high speeds can be sufficiently improved by increasing the air-fuel ratio in the operating region C at the relatively high engine speed side.

If the above control should be executed in an engine in which a fuel injection valve is provided in an intake port, an air-fuel ratio slowly changes (change of a fuel amount actually supplied into a combustion chamber) due to adhesion of the fuel to the wall surface of the intake port even if the fuel injection amount is suddenly changed during the transition from the lean region to the enriched region. Accordingly, exhaust gas temperature is likely to rise due to the combustion near the stoichimetric air-fuel ratio while the air-fuel ratio is being changed from the lean air-fuel ratio to the enriched air-fuel ratio. Contrary to this, in the inventive control system including the fuel injection valves 15 for directly spraying the fuel into the combustion chambers, the air-fuel ratio is immediately switched from the lean air-fuel ratio to the enriched air-fuel ratio as the fuel injection amount increases. Thus, a rise in exhaust gas temperature can be satisfactorily suppressed also during the transition from the lean region to the enriched region. Therefore, the control for improving fuel consumption at high speeds while ensuring reliability by setting the lean region at the relatively high engine speed side adjacent to the enriched region can be effectively realized.

Further, even in the lean region C, acceleration performance can be achieved by setting the air-fuel ratio equal to or smaller than the stoichiometric air-fuel ratio ($\lambda<1$) during a sudden acceleration. The air-fuel ratio is also set equal to or smaller than the stoichiometric air-fuel ratio ($\lambda<1$) when the sulfur release control is executed in the lean region C, designing to release sulfur by a rise in the temperature of the catalyst.

Reliability and fuel consumption are not considerably impaired since the air-fuel ratio is temporarily set equal to or smaller than the stoichiometric air-fuel ratio during the sudden acceleration and the sulfur release control.

Since the sulfur release control is desirably executed to increase the temperature of the catalyst and increase CO in the exhaust gas, it is desirable to set the air-fuel ratio smaller than the stoichimetric air-fuel ratio.

A secondary air supply passage 41 for supplying a secondary air flow and a secondary air supply control valve 42 for opening and closing the passage 41 may be provided downstream from the catalyst 17 in the exhaust passage 3 as indicated by phantom in FIG. 1. If the control valve 42 is also controlled by the ECU 25 to supply a secondary air flow into the exhaust passage 3 while making the air-fuel ratio in the combustion chambers smaller than the stoichiometric air-fuel ratio during the sulfur release control, the temperature of the catalyst can be more effectively increased.

Further, the air-fuel ratio is desirably set at the stoichiometric air-fuel ratio ($\lambda=1$) when the sulfur release control is executed during the sudden acceleration in the lean region. Then, acceleration performance is improved, sulfur is satisfactorily released from the catalyst by a rise in exhaust gas temperature caused by the acceleration, and deterioration of fuel consumption and emissions is prevented since the fuel is not excessively supplied.

For instance, the amount of fuel may be split and sprayed a plurality of times (e.g., twice) during the intake stroke by the fuel injection valve in the high engine speed side of the stoichiometric air-fuel ratio. If the split injections are performed during the intake stroke, dispersion and mixing of the fuel are promoted to enhance combustion efficiency, thus, improve fuel consumption, and a rise in exhaust gas temperature can be suppressed due to the enhanced combustion efficiency. Further, if the exhaust gas is recirculated by opening the EGR valve 19 in the operating region where the split injections are performed during the intake stroke, a rise in exhaust gas temperature can be further suppressed. In other words, NOx are reduced and the exhaust gas temperature falls if the exhaust gas is recirculated. Particularly, while the split injections are being performed during the intake stroke, a rise in exhaust gas temperature is suppressed by the split injections themselves. Since combustion stability is enhanced to admit a relatively large amount of the recirculated exhaust gas, a rise in exhaust gas temperature can be further suppressed.

As described above, an inventive control system is adapted for a direct injection engine of sparking ignition type including a catalyst in an exhaust passage and a fuel injection valve for directly spraying fuel into a combustion chamber, and comprises a setter for setting an enriched region where an air-fuel ratio is smaller than a stoichiometric air-fuel ratio in a high engine speed and load area of an operating region of the engine, setting a stoichiometric air-fuel ratio region where the air-fuel ratio is equal to the stoichiometric air-fuel ratio in an area of the operating region of the engine having lower engine speed or lower engine load than the enriched region, and setting a lean region where the air-fuel ratio is larger than the stoichiometric air-fuel ratio between the stoichiometric air-fuel ratio region and the enriched region; and an air-fuel ratio controller for controlling the air-fuel ratio based on the setting by the setter.

In the lean region, rise in exhaust gas temperature is suppressed by thermal capacity of air abundantly present in air-fuel mixture by increasing an amount of intake air to increase the air-fuel ratio, thereby preventing superheating of the catalyst. Further, combustion efficiency is enhanced by increasing the air-fuel ratio to improve fuel consumption. Particularly, the enriched region is made maximally small and fuel consumption at high speeds is improved by setting the lean region at a relatively high engine speed side adjacent to the enriched region.

Preferably, a high-pressure fuel pump may be provided in a fuel supply system for supplying the fuel to the fuel injection valve and may be driven by the engine to produce a fuel pressure of 4 MPa or higher in the lean region. With this construction, such a fuel pressure as to enable fuel injection during a compression stroke can be given to the fuel injection valve. In the case of providing the engine-driven high-pressure fuel pump, its resistance to drive increases as an engine speed rises, displaying a tendency to hinder improvement in fuel consumption at high speeds. However, such a tendency is corrected by the lean operation in the relatively high engine speed area.

Preferably, the air-fuel ratio controller may control the air-fuel ratio to be equal to or smaller than the stoichimetric air-fuel ratio even in the lean region during a sudden acceleration. With such a control, a reduction in acceleration performance can be prevented even in the lean region.

Preferably, the catalyst provided in the exhaust passage may be a lean NOx catalyst which displays a NOx purifying performance even in the lean region where the air-fuel ratio is larger than the stoichiometric air-fuel ratio. With such a catalyst, exhaust gas can be satisfactorily purified even during the lean operation of the engine.

Preferably, the lean NOx catalyst may be designed to absorb NOx in an excess oxygen atmosphere and release NOx as an oxygen concentration falls. The control system may further comprise a catalyst regeneration controller for controlling the lean NOx catalyst to release sulfur when the lean NOx catalyst reaches a specified sulfur absorbed state where its property of absorbing NOx is hindered, and the air-fuel ratio is changed to a value equal to or smaller than the stoichiometric air-fuel ratio when the control is executed to release sulfur from the lean NOx catalyst in the lean region. With this construction, sulfur can be satisfactorily released from the lean NOx catalyst by increasing the temperature of the catalyst even in the lean region.

Preferably, the control to release sulfur from the lean NOx catalyst may be executed by controllably setting the air-fuel ratio in the combustion chamber at a value smaller than the stoichiometric air-fuel ratio and supplying a secondary air flow into the exhaust passage. Such a control promotes a temperature increase of the catalyst, with the result that sulfur can be effectively released.

The air-fuel ratio may be changed to the stoichimetric air-fuel ratio in the lean region when the control to release sulfur from the lean NOx catalyst during an acceleration is executed. Such a construction ensures a sufficient acceleration performance and a satisfactory sulfur release.

Preferably, the fuel may be split and sprayed a plurality of times during an intake stroke by the fuel injection valve in a high engine speed area of the stoichiometric air-fuel ratio region. With this construction, dispersion and mixing of the fuel are promoted by the split injections during the intake stroke in the high engine speed area of the stoichiometric air-fuel ratio region, which enhances combustion efficiency and improves fuel consumption, and also suppresses rise in exhaust gas temperature due to the enhanced combustion efficiency.

In such a case, an exhaust gas may be preferably recirculated from an exhaust system to an intake system at least in an operating region where the fuel is split and sprayed a plurality of times during an intake stroke. The recirculation of the exhaust gas also acts to suppress rise in exhaust gas temperature.

Preferably, the catalyst may be provided downstream from an upstream exhaust pipe connected with an exhaust manifold. Rise in the temperature of the catalyst can be suppressed by arranging the catalyst in a relatively downstream position of the exhaust passage.

Preferably, a throttle valve which is driven by an electrical driver may be provided to regulate the amount of intake air. The air-fuel ratio controller may control the air-fuel ratio by controlling the throttle valve and the amount of fuel sprayed from the fuel injection valve. With such a throttle valve, the control to change the air-fuel ratio in accordance with the operating region can be effectively executed.

As this invention may be embodied in several forms without departing from the spirit of essential characteristics thereof , the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A control system for a direct injection engine of a sparking ignition type which is provided with a catalyst in an exhaust passage and a fuel injection valve for directly spraying fuel into a combustion chamber, comprising:

a setter for setting an enriched region where an air-fuel ratio is smaller than a stoichiometric air-fuel ratio in a high engine speed region near a maximum engine speed and a high engine load region near a maximum engine load of an operating region of the engine, setting a stoichiometric air-fuel ratio region where the air-fuel ratio is equal to the stoichiometric air-fuel ratio in an area of the operating region of the engine having a lower engine speed or lower engine load than the enriched region, and setting a lean region in the high engine speed region where the air-fuel ratio is larger than the stoichiometric air-fuel ratio and between the stoichiometric air-fuel ratio region and the enriched region, and an air-fuel ratio controller for controlling the air-fuel ratio based on the setting by the setter.

2. A control system according to claim 1, further comprising a high-pressure fuel pump in a fuel supply system for supplying the fuel to the fuel injection valve and driven by the engine to produce a fuel pressure of 4 MPa or higher in the lean region.

3. A control system according to claim 1, wherein the catalyst provided in the exhaust passage is a lean NOx catalyst which displays a NOx purifying performance even in the lean region where the air-fuel ratio is larger than the stoichiometric air-fuel ratio.

4. A control system according to claim 3, wherein the lean NOx catalyst is designed to absorb NOx in an excess oxygen atmosphere and release NOx as an oxygen concentration falls, further comprising a catalyst regeneration controller for controlling the lean NOx catalyst to release sulfur when the lean NOx catalyst reaches a specified sulfur absorbed state where its property of absorbing NOx is hindered, the air-fuel ratio being changed to a value equal to or smaller than the stoichiometric air-fuel ratio when the control is executed to release sulfur from the lean NOx catalyst in the lean region.

5. A control system according to claim 4, wherein the control to release sulfur from the lean NOx catalyst is executed by controllably setting the air-fuel ratio in the combustion chamber at a value smaller than the stoichimetric air-fuel ratio and supplying a secondary air flow into the exhaust passage.

6. A control system according to claim 1, wherein the fuel is split and sprayed a plurality of times during an intake stroke by the fuel injection valve in a high engine speed area of the stoichiometric air-fuel ratio region.

7. A control system according to claim 6, wherein an exhaust gas is recirculated from an exhaust system to an intake system at least in an operating region where the fuel is split and sprayed a plurality of times during an intake stroke.

8. A control system according to claim 1, wherein the catalyst is provided downstream from an upstream exhaust pipe connected with an exhaust manifold.

9. A control system according to claim 1, wherein the engine is provided with a throttle valve which is driven by an electrical driver to regulate the amount of intake air, and the air-fuel ratio controller controls the air-fuel ratio by controlling the throttle valve and an amount of the fuel sprayed from the fuel injection valve.

10. A control system for a direct injection engine of a sparking ignition type which is provided with a catalyst in an exhaust passage and a fuel injection valve for directly spraying fuel into a combustion chamber, comprising:

a setter for setting an enriched region where an air-fuel ratio is smaller than a stoichiometric air-fuel ratio in a high engine speed region near a maximum engine speed and a high engine load region near a maximum engine load of an operating region of the engine, setting a stoichiometric air-fuel ratio region where the air-fuel ratio is equal to the stoichiometric air-fuel ratio in an area of the operating region of the engine having a lower engine speed or lower engine load than the enriched region, and setting a lean region in the high engine speed region where the air-fuel ratio is larger than the stoichiometric air-fuel ratio and between the stoichiometric air-fuel ratio region and the enriched region, and an air-fuel ratio controller for controlling the air-fuel ratio based on the setting by the setter;

wherein the air-fuel ratio controller controls the air-fuel ratio to be equal to or smaller than the stoichiometric air-fuel ratio even in the lean region during a sudden acceleration.

11. A control system for a direct injection engine of a sparking ignition type which is provided with a lean NOx catalyst in an exhaust passage and displaying a NOx purifying performance even in a lean operating region where an air-fuel ratio is larger than a stoichiometric air-fuel ratio, a fuel injection valve for directly spraying fuel into a combustion chamber, a sparking plug facing the combustion chamber, an electrically driven throttle valve in an intake passage, the control system comprising:

an acceleration pedal travel sensor for detecting a travel of an acceleration pedal upon depression;

a sensor for detecting an engine speed; and an engine control unit for controlling the amount of the fuel to be sprayed and the throttle valve upon receiving signals from the respective sensors, thereby controlling the air-fuel ratio, wherein the engine control unit stores a control map in which an enriched region where an air-fuel ratio is smaller than a stoichiometric air-fuel ratio is set in a high engine speed region near a maximum engine speed and a high engine load region near a maximum engine load of an operating region of the engine, a stoichiometric air-fuel ratio region where the air-fuel ratio is equal to the stoichiometric air-fuel ratio is set in an area of the operating region of the engine having a lower engine speed or lower engine load than the enriched region, and a lean region in the high engine speed region where the air-fuel ratio is larger than the stoichiometric air-fuel ratio is set and between the stoichiometric air-fuel ratio region and the enriched region, and controls the air-fuel ratio in accordance with the control map.

12. A control system according to claim 11, wherein the engine control unit causes the fuel injection valve to split and spray the fuel a plurality of times during an intake stroke in a high engine speed area of the stoichiometric air-fuel ratio region.

13. A control system according to claim 11, wherein the lean NOx catalyst is designed to absorb NOx in an excess oxygen atmosphere and release NOx as an oxygen concentration falls, wherein the engine control unit executes a control to release sulfur from the lean NOx catalyst when the lean NOx catalyst reaches a specified sulfur absorbed state where its property of absorbing NOx is hindered, and changes the air-fuel ratio to or below the stoichiometric air-fuel ratio when the control is executed to release sulfur from the lean NOx catalyst in the lean region.

14. A control system according to claim 13, wherein the control to release sulfur from the lean NOx catalyst is executed by controllably setting the air-fuel ratio in the combustion chamber below the stoichiometric air-fuel ratio and supplying a secondary air flow into the exhaust passage.

15. A control system for a direct injection engine of sparking ignition type which is provided with a lean NOx catalyst in an exhaust passage and displaying a NOx purifying performance even in a lean operating region where an air-fuel ratio is larger than a stoichiometric air-fuel ratio, a fuel injection valve for directly spraying fuel into a combustion chamber, a sparking plug facing the combustion chamber, an electrically driven throttle valve in an intake passage, the control system comprising:

an acceleration pedal travel sensor for detecting a travel of an acceleration pedal upon depression;

a sensor for detecting an engine speed; and an engine control unit for controlling the amount of the fuel to be sprayed and the throttle valve upon receiving signals from the respective sensors, thereby controlling the air-fuel ratio, wherein the engine control unit stores a control map in which an enriched region where an air-fuel ratio is smaller than a stoichiometric air-fuel ratio is set in a high engine region near a maximum engine speed and a high engine load region near a maximum engine load of an operating region of the engine, a stoichiometric air-fuel ratio region where the air-fuel ratio is equal to the stoichiometric air-fuel ratio is set in an area of the operating region of the engine having a lower engine speed or lower engine load than the enriched region, and a lean region in the high engine speed region where the air-fuel ratio is larger than the stoichiometric air-fuel ratio is set and between the stoichiometric air-fuel ratio region and the enriched region, and controls the air-fuel ratio in accordance with the control map;

wherein the engine control unit controls the air-fuel ratio to be smaller than the stoichiometric air-fuel ratio even in the lean region during a sudden acceleration.

* * * * *